US008104286B2

(12) United States Patent
Zuo et al.

(10) Patent No.: US 8,104,286 B2
(45) Date of Patent: Jan. 31, 2012

(54) METHODS AND SYSTEMS TO ENHANCE FLAME HOLDING IN A GAS TURBINE ENGINE

(75) Inventors: Baifang Zuo, Simpsonville, SC (US); Benjamin Paul Lacy, Greer, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 517 days.

(21) Appl. No.: 12/350,134

(22) Filed: Jan. 7, 2009

(65) Prior Publication Data

US 2010/0170255 A1 Jul. 8, 2010

(51) Int. Cl.

| | |
|---|---|
| ***F02C 7/22*** | (2006.01) |
| ***F23R 3/14*** | (2006.01) |
| ***F23R 3/28*** | (2006.01) |
| ***B05B 7/10*** | (2006.01) |

(52) U.S. Cl. ..... 60/748; 60/742; 239/403; 239/399; 29/890.02

(58) Field of Classification Search ..... 60/737, 60/742, 748; 239/399, 403; 29/890.02
See application file for complete search history.

(56) References Cited

U.S. PATENT DOCUMENTS

| | | | | |
|---|---|---|---|---|
| 4,854,127 | A | 8/1989 | Vinson et al. | |
| 5,511,375 | A * | 4/1996 | Joshi et al. | 60/737 |
| 6,286,300 | B1 | 9/2001 | Zelina et al. | |
| 6,438,961 | B2 * | 8/2002 | Tuthill et al. | 60/737 |
| 6,655,145 | B2 * | 12/2003 | Boardman | 60/737 |
| 6,698,207 | B1 | 3/2004 | Wiebe et al. | |
| 6,820,411 | B2 * | 11/2004 | Pederson et al. | 60/748 |
| 6,832,481 | B2 | 12/2004 | Koenig et al. | |
| 6,993,916 | B2 | 2/2006 | Johnson et al. | |
| 7,093,445 | B2 | 8/2006 | Corr, II et al. | |
| 7,377,036 | B2 * | 5/2008 | Johnson et al. | 60/742 |
| 2002/0174656 | A1 * | 11/2002 | Hein | 60/737 |
| 2010/0077760 | A1 * | 4/2010 | Laster et al. | 60/742 |

* cited by examiner

*Primary Examiner* — Ted Kim
(74) *Attorney, Agent, or Firm* — Armstrong Teasdale LLP

(57) ABSTRACT

A fuel nozzle including a swirler assembly that includes a shroud, a hub, and a plurality of vanes extending between the shroud and the hub. Each vane includes a pressure sidewall and an opposite suction sidewall coupled to the pressure sidewall at a leading edge and at a trailing edge. At least one suction side fuel injection orifice is formed adjacent to the leading edge and extends from a first fuel supply passage to the suction sidewall. A fuel injection angle is oriented with respect to the suction sidewall. The suction side fuel injection orifice is configured to discharge fuel outward from the suction sidewall. At least one pressure side fuel injection orifice extends from a second fuel supply passage to the pressure sidewall and is substantially parallel to the trailing edge. The pressure side fuel injection orifice is configured to discharge fuel tangentially from the trailing edge.

22 Claims, 5 Drawing Sheets

METHODS AND SYSTEMS TO ENHANCE FLAME HOLDING IN A GAS TURBINE ENGINE

STATEMENT REGARDING FEDERALLY SPONSORED RESEARCH & DEVELOPMENT

This invention was made with Government support under DE-FC26-05NT42643 awarded by the Department of Energy ("DOE"). The Government has certain rights in this invention.

BACKGROUND OF THE INVENTION

This disclosure relates generally to gas turbine engines and more particularly, to methods and systems to enhance flame-holding during turbine operation.

At least some gas turbine engines ignite a fuel-air mixture in a combustor to generate a combustion gas stream that is channeled downstream to a turbine via a hot gas path. Compressed air is channeled to the combustor from a compressor. Combustor assemblies typically have fuel nozzles that facilitate fuel and air delivery to a combustion zone defined in the combustor. The turbine converts the thermal energy of the combustion gas stream to mechanical energy that rotates a turbine shaft. The output of the turbine may be used to power a machine, for example, an electric generator or a pump.

At least some known fuel nozzles include a swirler assembly and a plurality of vanes that are coupled to the swirler assembly. During fabrication in some of such nozzles, a cover is coupled to the fuel nozzle assembly such that the cover substantially circumscribes the vanes. As such, an interior surface of the cover and an exterior surface of the swirler assembly define a flowpath for channeling flow through the fuel nozzle.

During operation, fuel is typically channeled through a plurality of passages formed within the swirler assembly and through a plurality of openings defined in at least one side of each vane. Known vanes may also include a cavity that is formed such that fuel channeled through the swirler assembly passages is discharged into the vane cavity. Moreover, each of such vanes includes a plurality of openings, commonly referred to as fuel injection holes, that extend through a sidewall of the vane and that are substantially normal to a surface of the vane sidewall to enable fuel channeled into the vane cavity to be channeled from the vane cavity through the sidewall injection hole to mix with the air stream that is flowing through the nozzle.

Moreover, in at least some known swirler assembly designs, vane flame holding may be different when using highly reactive fuels. Known methods to improve flame holding have included modifying a location, a number, and/or a size of the fuel injection holes. However, using known methods may decrease flame-holding margins of a fuel nozzle below desired allowable limits for high reactive fuels, such as syngas or high hydrogen fuel. Poor flame holding performance may create hot spots or streaks that exceed local maximum operating temperatures of the associated turbine engine and/or damage the fuel nozzle. Although such known methods have provided some improvements in fuel nozzle performance, there still exists a desire to improve fuel nozzle performance and to enhance flame holding characteristics.

BRIEF DESCRIPTION OF THE INVENTION

In one aspect, a method for fabricating a fuel nozzle is provided. The method includes fabricating a swirler assembly that includes a shroud, a hub, and a plurality of vanes extending between the shroud and the hub, wherein each of the plurality of vanes includes a pressure sidewall and an opposite suction sidewall that is coupled to the pressure sidewall at a leading edge and at an axially-spaced trailing edge. The method further includes forming at least one suction side fuel injection orifice adjacent to the leading edge, wherein the orifice extends from a first fuel supply passage to the suction sidewall such that a fuel injection angle is formed with respect to the suction sidewall. The method also includes forming at least one pressure side fuel injection orifice that extends from at least one of the first fuel supply passage and a second fuel supply passage to the pressure sidewall and that is substantially parallel to the trailing edge, wherein the at least one pressure side fuel injection orifice is configured to discharge fuel in a direction that is tangential to the trailing edge.

In another aspect, a fuel nozzle assembly is provided. The fuel nozzle assembly includes a swirler assembly having a shroud and a hub. A plurality of vanes extend between the shroud and the hub. Each vane includes a pressure sidewall and an opposite suction sidewall coupled to the pressure sidewall at a leading edge and at an axially-spaced trailing edge. At least one suction side fuel injection orifice is formed adjacent to the leading edge and extends from a first fuel supply passage to the suction sidewall such that a fuel injection angle is formed with respect to the suction sidewall. The at least one suction side fuel injection orifice is configured to discharge fuel outward from the suction sidewall. The fuel nozzle also includes at least one pressure side fuel injection orifice extending from at least one of the first fuel supply passage and a second fuel supply passage to the pressure sidewall. The at least one pressure side fuel injection orifice is substantially parallel to the trailing edge and is configured to discharge fuel tangentially from the trailing edge.

In a further aspect, a gas turbine engine is provided. The engine includes a compressor and a combustor coupled in flow communication with the compressor. The combustor further includes at least one fuel nozzle assembly. The fuel nozzle assembly includes a swirler assembly that further includes a shroud, a hub and a plurality of vanes extending between the shroud and the hub. Each vane includes a pressure sidewall and a suction sidewall coupled to the pressure sidewall at a leading edge and at an axially-spaced trailing edge. Each vane further includes at least one suction side fuel injection orifice defined adjacent to the leading edge and extending from a first fuel supply passage to the suction sidewall. A fuel injection angle is formed with respect to the suction sidewall, the at least one suction side fuel injection orifice is configured to discharge fuel from the suction sidewall. Each vane also includes at least one pressure side fuel injection orifice extending from at least one of the first fuel supply passage and a second fuel supply passage to the pressure sidewall and extending substantially parallel to the trailing edge and configured to discharge fuel tangentially from the trailing edge.

DETAILED DESCRIPTION OF THE INVENTION

Figure 1:
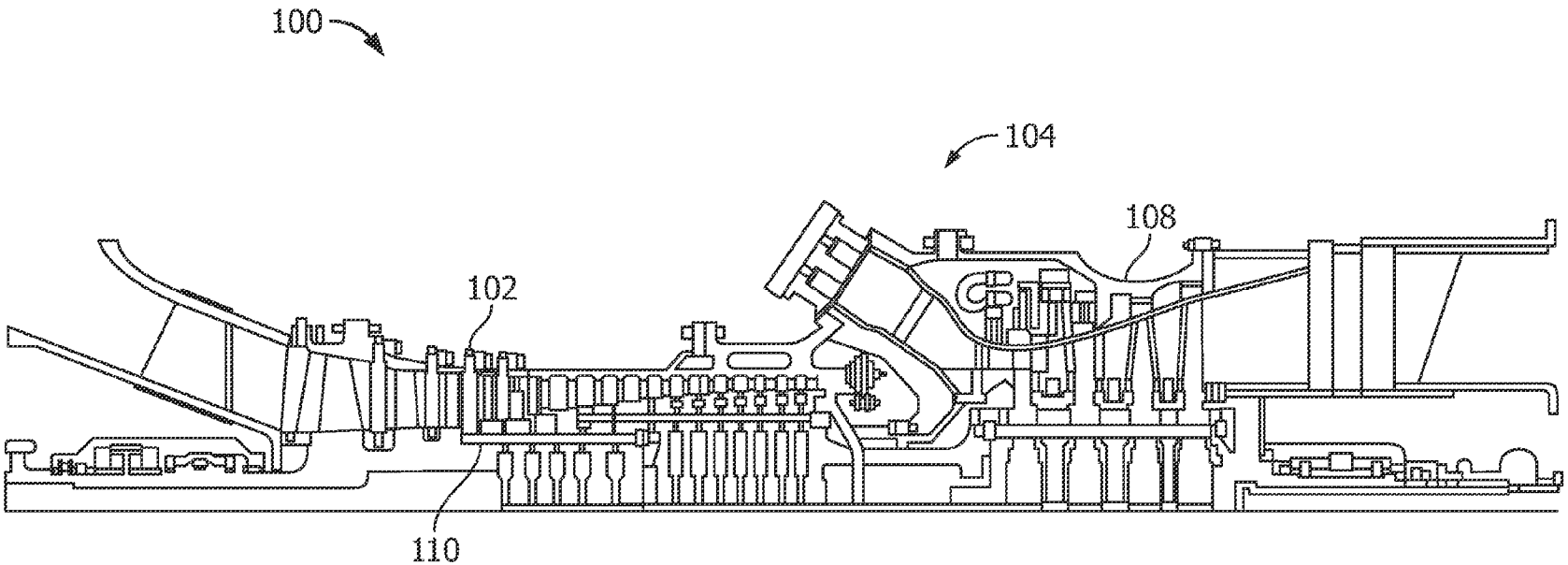
FIG. 1 is a schematic view of an exemplary gas turbine engine.

FIG. 1 is a schematic illustration of an exemplary gas turbine engine 100. Engine 100 includes a compressor 102 and a plurality of circumferentially spaced combustors 104. Engine 100 also includes a turbine 108 and a common compressor/turbine shaft 110 (sometimes referred to as a rotor 110).

In operation, air flows through compressor 102 such that compressed air is supplied to combustors 104. Fuel is channeled to a combustion region, within combustors 104 wherein the fuel is mixed with the air and ignited. Combustion gases are generated and channeled to turbine 108 wherein gas stream thermal energy is converted to mechanical rotational energy. Turbine 108 is rotatably coupled to, and drives, shaft 110. It should also be appreciated that the term "fluid" as used herein includes any medium or material that flows, including, but not limited to, gas and air.

Figure 2:
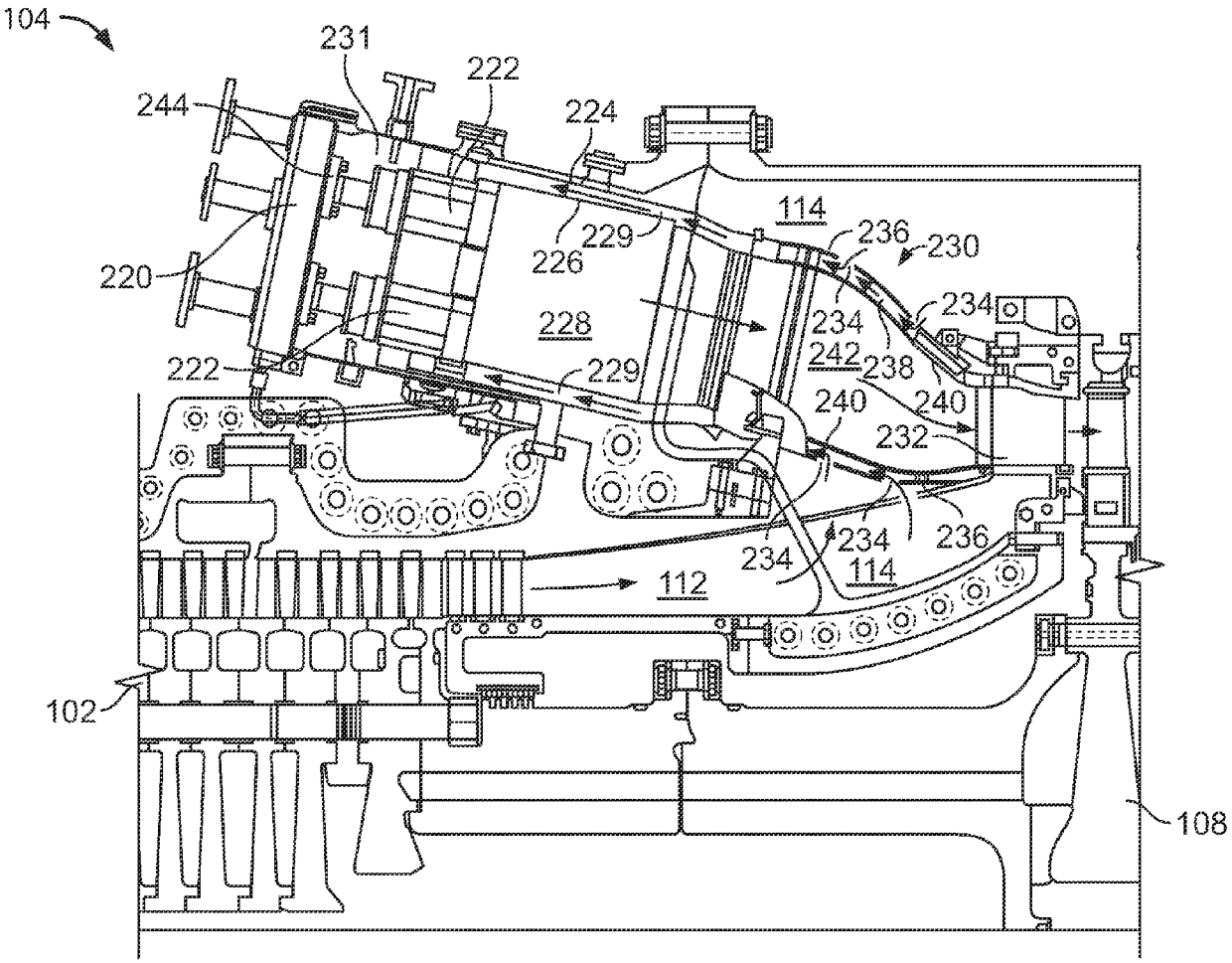
FIG. 2 is a cross-sectional schematic view of an exemplary combustor that may be used with the gas turbine engine shown in FIG. 1.

FIG. 2 is a cross-sectional schematic view of a combustor assembly 104. Combustor assembly 104 is coupled in flow communication with turbine assembly 108 and with compressor assembly 102. In the exemplary embodiment, compressor assembly 102 includes a diffuser 112 and a compressor discharge plenum 114 that are coupled in flow communication to each other.

In one exemplary embodiment, combustor assembly 104 includes an end cover 220 that provides structural support to a plurality of fuel nozzles 222. In the exemplary embodiment, nozzle assemblies 222 are oriented in an annular array about a turbine housing (not shown). End cover 220 is coupled to combustor casing 224 with retention hardware (not shown in FIG. 2). A combustor liner 226 is positioned within and is coupled to casing 224 such that liner 226 defines a combustion chamber 228. An annular combustion chamber cooling passage 229 extends between combustor casing 224 and combustor liner 226.

A transition portion or piece 230 is coupled to combustor chamber 228 to facilitate channeling combustion gases generated in chamber 228 downstream towards a turbine nozzle 232. In one exemplary embodiment, transition piece 230 includes a plurality of openings 234 formed in an outer wall 236. Transition piece 230 also includes an annular passage 238 defined between an inner wall 240 and outer wall 236. Inner wall 240 defines a guide cavity 242.

In operation, turbine assembly 108 drives compressor assembly 102 via shaft 110 (shown in FIG. 1). As compressor assembly 102 rotates, compressed air is discharged into diffuser 112 as the associated arrows illustrate. In one exemplary embodiment, the majority of air discharged from compressor assembly 102 is channeled through compressor discharge plenum 114 towards combustor assembly 104, and a smaller portion of compressed air may be channeled for use in cooling engine 100 components. More specifically, the pressurized compressed air within plenum 114 is channeled into transition piece 230 via outer wall openings 234 and into passage 238. Air is then channeled from transition piece annular passage 238 into combustion chamber cooling passage 229. Air is discharged from passage 229 and is channeled into fuel nozzles 222.

Fuel and air are mixed and ignited within combustion chamber 228. Casing 224 facilitates isolating combustion chamber 228 from the outside environment, for example, surrounding turbine components. Combustion gases generated are channeled from chamber 228 through transition piece guide cavity 242 towards turbine nozzle 232. In one exemplary embodiment, fuel nozzle assembly 222 is coupled to end cover 220 via a fuel nozzle flange 244.

Figure 3:
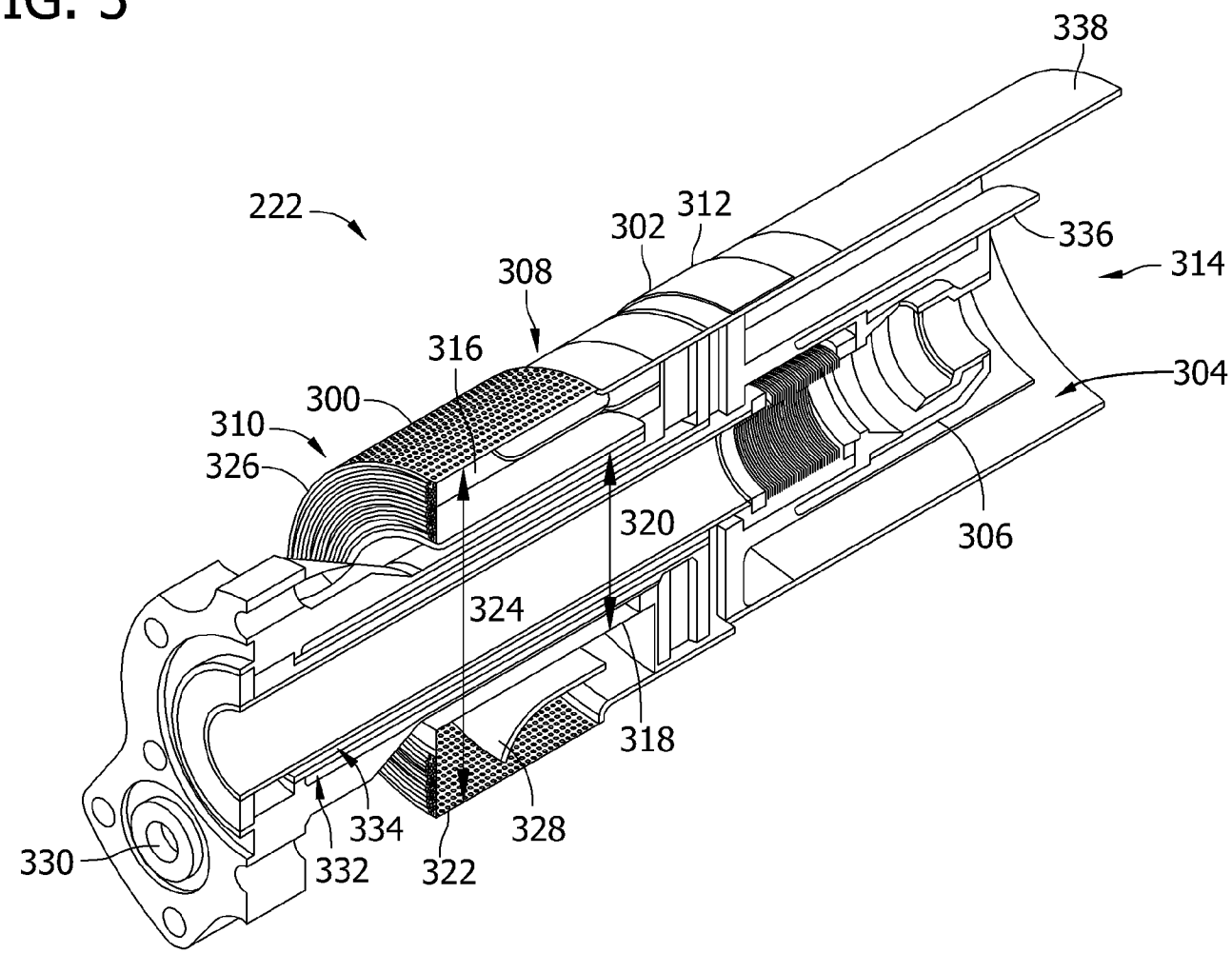
FIG. 3 is a perspective cross-sectional view of an exemplary fuel nozzle assembly that may be used with the combustor shown in FIG. 2.

FIG. 3 is a cross-sectional view of fuel nozzle assembly 222. Fuel nozzle assembly 222 includes an inlet flow conditioner (IFC) 300, a swirler assembly 302 with fuel injection, an annular fuel fluid mixing passage 304, and a central diffusion flame fuel nozzle assembly 306. Fuel nozzle assembly 222 also includes an inlet end 310 and a discharge end 314 at the right side of the passage. Outer nozzle wall 308 circumscribes nozzle assembly 222. The discharge end 314 of the passage does not circumscribe nozzle assembly 222, but rather feeds into a combustor reaction zone 314. Fuel nozzle assembly 222 includes an annular flow passage 316 that is defined by a cylindrical wall 318. Wall 318 defines an inside diameter 320 for passage 316, and a perforated cylindrical outer wall 322 defines an outside diameter 324. In the exemplary embodiment, a perforated end cap 326 is coupled to an upstream end of fuel nozzle assembly 222. In the exemplary embodiment, flow passage 316 includes at least one annular guide vane 328 positioned thereon. Moreover, it should be understood that in the exemplary embodiment, nozzle assembly 222 defines a premix gas fuel circuit wherein fuel and compressed fluid are mixed prior to combustion.

Figure 4:
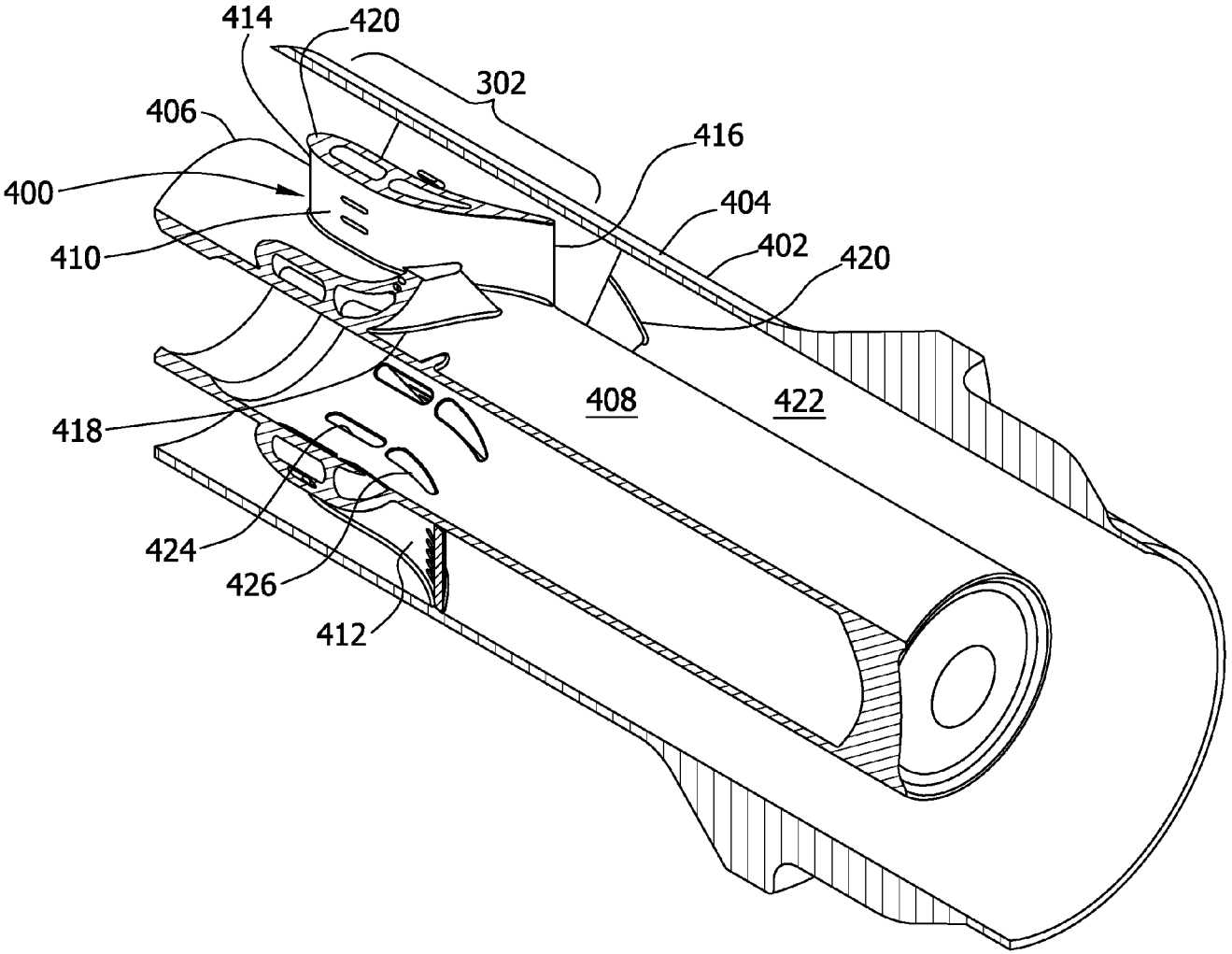
FIG. 4 is an enlarged perspective cross-sectional view of a portion of the fuel nozzle assembly shown in FIG. 3.
Figure 5:
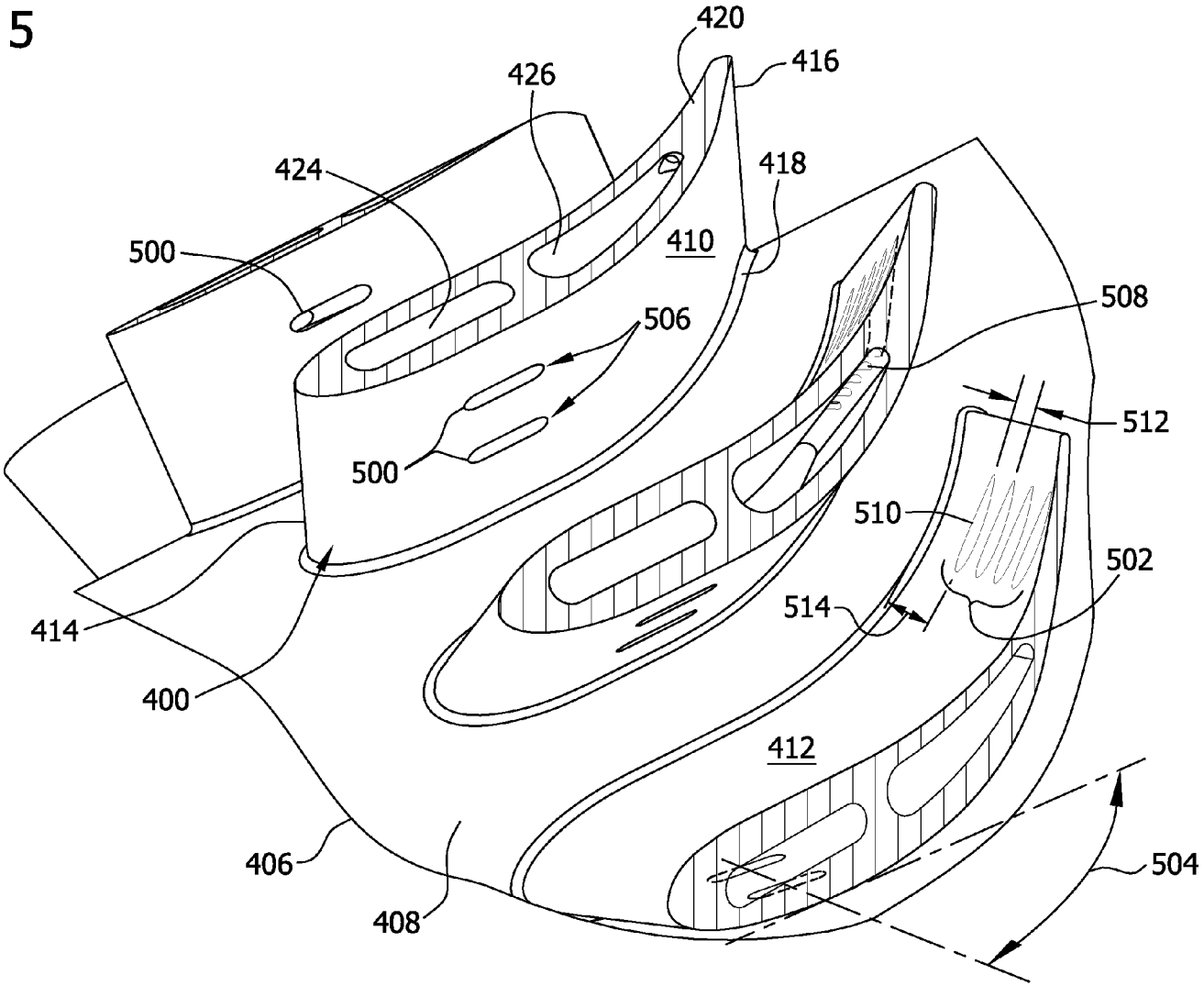
FIG. 5 is an enlarged perspective cross-sectional view of a portion of an exemplary swirler vane assembly that may be used with the fuel nozzle assembly shown in FIGS. 3 and 4.

FIG. 4 is an enlarged perspective cross-sectional view of a portion of fuel nozzle assembly 222. FIG. 5 is an enlarged perspective cross-sectional view of a portion of an exemplary turning or swirler vane 400. In the exemplary embodiment, fuel nozzle assembly 222 includes a swirler assembly 302. Swirler assembly 302 includes a plurality of turning vanes 400 that each extend between an outer surface 404 of radially outer shroud 402 and an outer surface 408 of a radially inner hub 406. Each vane 400 includes a suction sidewall 410 and a pressure sidewall 412.

Suction sidewall 410 is convex and defines a suction side of vane 400, and pressure sidewall 412 is concave and defines a pressure side of vane 400. Sidewalls 410 and 412 are joined at a leading edge 414 and at an axially-spaced trailing edge 416 of vanes 400. Suction and pressure sidewalls 410 and 412, respectively, extend longitudinally, between radially inner hub 406 and radially outer shroud 402. Each vane 400 also includes a vane root 418 defined adjacent to inner hub 406, and a vane tip 420 defined adjacent to an inner surface 422 of outer shroud 402.

It should be understood that turning vanes 400 impart swirl to compressed fluid flowing through swirler assembly 302. Moreover, turning vanes 400 each include a first fuel supply passage 424 and a second fuel supply passage 426 that are each defined in a core (not shown) of each vane 400. In the exemplary embodiment, each vane suction sidewall 410 includes a plurality of fuel injection orifices 500 formed therein, and each vane pressure sidewall 412 includes a plurality of fuel injection orifices 502 formed therein. First fuel supply passage 424 is positioned in fluid communication with fuel injection orifices 500 and second fuel supply passage 426 is positioned in fluid communication with fuel injection orifices 502. It should be noted that in an alternate embodiment a single fuel supply passage can supply both sets of orifices 500 and 502

During operation, first fuel supply passage 424 and second fuel supply passage 426 distribute fuel to orifices 500 and 502, respectively. Fuel enters swirler assembly 302 through fuel inlet port 330 (shown in FIG. 3) and through first and second annular premix gas fuel passages 332 and 334 (shown in FIG. 3). Fuel passages 332 and 334 supply fuel to supply passage 424 and to fuel supply passage 426, respectively. The fuel mixes with compressed fluid in swirler assembly 302, and fuel/air mixing is completed in annular premix passage 304 (shown in FIG. 3). Passage 304 is defined by a fuel nozzle hub extension 336 (shown in FIG. 3) and by a fuel nozzle shroud extension 338 (shown in FIG. 3). A majority of compressed fluid used for combustion enters fuel nozzle assembly 222 via IFC 300 and is channeled through swirler assembly 302 after being discharged from IFC 300. After exiting annular premix passage 304, the fuel/air mixture enters combustor reaction zone 314 wherein the mixture is ignited. During operation, compressed fluid enters IFC 300 via perforations in end cap 326 and cylindrical outer wall 318.

In the exemplary embodiment, turning vane 400 is formed with a plurality of suction side fuel injection orifices 500 that are adjacent to the leading edge 414, or alternatively along a flat region of vane 400. Fuel injection orifices 500 extend from first fuel supply passage 424 and thru suction sidewall 410 and are originated any of a desired range of injection angles with respect to a surface profile of suction sidewall 410 based on optimizing performance requirements. For example, in one embodiment, fuel injection orifices 500 are oriented at approximately a 30° injection angle 504. In the exemplary embodiment, suction side fuel injection orifices 500 are shaped as elongated slots. Alternatively, any shape may be used that facilitates fluid flow characteristics there through as described herein. Moreover, in the exemplary embodiment, fuel injection orifices 500 are formed with contoured edges (not shown in FIG. 5) that facilitate fluid flow characteristics there through. The contoured edges may be chamfered, beveled, rounded, and/or any combination of such features. However, one of ordinary skill in the art should appreciate and understand that other low injection angles and/or other orifice shapes may be used to modify the fuel flow characteristics as desired.

A low injection angle 504 facilitates reducing wake flow behind each fuel injection site 506 and also facilitates reducing a fuel column penetration height and flame holding velocity such that flame holding characteristics are improved. Additionally, fuel injection via suction side fuel injection orifices 500 substantially facilitates reducing surface fuel flow recirculation at each fuel injection location, where cross flow compressed fluid velocity is high. A high injection angle 504 will enhance mixing of the fuel and air, but will increase flow separation behind the fuel jet.

Turning vane 400 is formed with a plurality of pressure side fuel injection orifices 502. Injection orifices 502 are formed such that each orifice 502 extends from second fuel supply passage 426 or a common fuel passage as desired and thru a portion of pressure sidewall 412 adjacent to trailing edge 416. Pressure side fuel injection orifices 502 are generally parallel to vane trailing edge 416. Each fuel injection orifice 502 includes a fuel inlet end 508 and a fuel discharge end 510. Fuel inlet end 508 is located within second fuel supply passage 426 or a common fuel passage and in the exemplary embodiment, is substantially circular. Fuel discharge end 510 discharges fuel in a direction that is substantially tangential to trailing edge 416. Additionally, in the exemplary embodiment, fuel discharge end 510 is generally elliptical with respect to an outer surface of pressure sidewall 412. Fuel inlet end 508 and fuel discharge end 510 may each include contoured edges (not shown in FIG. 5) that facilitate desired fluid flow characteristics there through. Such contoured edges may be chamfered, beveled, rounded, and/or any combination of such features.

In the exemplary embodiment, pressure side fuel injection orifices 502 are separated by an orifice-to-orifice distance 512 that is longer than twice a diameter of each fuel inlet end 508. Fuel injection orifices 502 may also be separated with an orifice-to-wall distance 514 that is longer than twice fuel inlet end diameter 508. Spacing adjacent pressure side fuel injection orifices 502 a distance 512 apart, and/or a distance 514 apart facilitates reducing trailing edge fuel jet to jet interaction and thus improving local flame holding margin.

Fuel injection orifices 502 are formed such that each orifice 502 is oriented substantially parallel to vane trailing edge 416 to facilitate reducing or eliminating jet cross flow. Additionally, trailing edge fuel injection via pressure side fuel injection orifices 502 facilitates reducing surface fuel flow recirculation at each fuel injection site.

Swirler assembly 302, turning vanes 400, and inner hub 406 may be fabricated as a unitary structure through a manufacturing process such as, but not limited to, a casting process, a machining process, an injection molding process or combination of such processes. Additionally, fuel supply passages 424 and 426, as well as fuel injection orifices 500 and 502 may be formed during the fabrication of the unitary structure. Alternatively, supply passages 424 and 426 and/or injection orifices 500 and 502 may be formed in one or more subsequent fabrication steps.

In operation, fuel nozzle assembly 222 receives compressed air from cooling passage 229 (shown in FIG. 2) via a plenum 231 (shown in FIG. 2). Fuel nozzle assembly 222 receives fuel via fuel inlet port 330. Fuel is channeled from fuel inlet port 330 towards vanes 400. Additionally, air channeled into fuel nozzle 222 is mixed with fuel, and the resulting fuel/air mixture is swirled via turning vanes 400 as it is channeled downstream and discharged from fuel nozzle assembly 222.

The invention described herein provides several advantages not available in known fuel nozzle configurations. For example, one advantage of the fuel nozzles described herein is that the fuel column penetration height and flame holding velocity of each assembly is reduced, which facilitates improved flame holding characteristics. Another advantage is that the fuel injection orifices defined on both the suction side and pressure sides of the trailing edge facilitate reducing surface fuel flow recirculation. Another exemplary advantage of the fuel injection orifice configuration described herein is that such a configuration facilitates increasing fuel/air mixing at the burner tube exit and thus reducing combustion generated pollutants. Moreover, such an assembly facilitates reducing uneven fuel distribution among the fuel injection orifices by providing separate fuel supply passages for both the pressure and suction side fuel injection orifices. In addition, because of the high reactive fuel flame holding margins of the assembly other fuel sources may be used.

Exemplary embodiments of methods and systems to enhance flame holding in a gas turbine engine are described above in detail. The methods and systems are not limited to the specific embodiments described herein, but rather, components of systems and/or steps of the methods may be utilized independently and separately from other components and/or steps described herein. For example, the methods may also be used in combination with other fuel systems and methods, and are not limited to practice with only the fuel systems and methods as described herein. Rather, the exemplary embodiment can be implemented and utilized in connection with many other gas turbine engine applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention can be practiced with modification within the spirit and scope of the claims.

What is claimed is:

1. A method for fabricating a fuel nozzle, said method comprising:

fabricating a swirler assembly that includes a shroud, a hub, and a plurality of vanes extending between the shroud and the hub, wherein each of the plurality of vanes includes a concave pressure sidewall and an opposite convex suction sidewall that is coupled to the pressure sidewall at a leading edge and at an axially-spaced trailing edge;

forming at least one suction side fuel injection orifice adjacent to the leading edge in the suction sidewall, wherein the orifice extends from a first fuel supply passage to the suction sidewall such that a fuel injection angle is formed with respect to the suction sidewall; and forming at least one pressure side fuel injection orifice in the pressure sidewall that extends from at least one of the first fuel supply passage and a second fuel supply passage to the pressure sidewall and the at least one pressure side fuel injection orifice is configured to discharge fuel in a downstream direction that is substantially tangential to the trailing edge.

2. A method in accordance with claim 1, further comprising:

forming the at least one suction side fuel injection orifice as an elongated slot in the suction sidewall, wherein the elongated slot is defined by at least one contoured edge; and forming the at least one suction side fuel injection orifice with a fuel injection angle of between about 30 and about 90 degrees.

3. A method in accordance with claim 1, wherein forming at least one pressure side fuel injection orifice includes forming a fuel inlet end having at least one contoured edge and an opposing fuel discharge end, wherein the fuel inlet end is substantially circular and the fuel discharge end is substantially oval.

4. A method in accordance with claim 1, further comprising forming the first fuel supply passage that fluidly couples with the at least one suction side fuel injection orifice and the second fuel supply passage fluidly couples with the at least one pressure side fuel injection orifice.

5. A method in accordance with claim 1, further comprising forming the at least one suction side fuel injection orifice to reduce a fuel column penetration height and a flame holding velocity, and wherein the at least one pressure side fuel injection orifice is configured to reduce jet cross flow.

6. A method in accordance with claim 1, further comprising forming the at least one suction side fuel injection orifice and the at least one pressure side fuel injection orifice to facilitate eliminating fuel flow recirculation.

7. A fuel nozzle comprising:

a swirler assembly comprising a shroud and a hub;

a plurality of vanes extending between said shroud and said hub, each of said vanes comprising:

a concave pressure sidewall and an opposite convex suction sidewall coupled to said pressure sidewall at a leading edge and at an axially-spaced trailing edge;

at least one suction side fuel injection orifice formed adjacent to said leading edge in the suction sidewall, said at least one suction side fuel injection orifice extending from a first fuel supply passage to said suction sidewall and oriented at a fuel injection angle with respect to said suction sidewall, said at least one suction side fuel injection orifice is configured to discharge fuel outward from said suction sidewall at the fuel injection angle; and at least one pressure side fuel injection orifice formed in the pressure sidewall extending from at least one of a-the first fuel supply passage and a second fuel supply passage to said pressure sidewall, said at least one pressure side fuel injection orifice being configured to discharge fuel in a downstream direction that is substantially tangential to said trailing edge.

8. A fuel nozzle in accordance with claim 7, wherein said at least one suction side fuel injection orifice comprises an elongated slot formed in said suction sidewall.

9. A fuel nozzle in accordance with claim 8, wherein elongated slot is defined by at least one contoured edge.

10. A fuel nozzle in accordance with claim 7, wherein said fuel injection angle is between about 30 and about 90 degrees.

11. A fuel nozzle in accordance with claim 7 wherein said at least one pressure side fuel injection orifice comprises a fuel inlet end and an opposite fuel discharge end, said fuel inlet end is substantially circular, said fuel discharge end is elliptical.

12. A fuel nozzle in accordance with claim 11, wherein said fuel inlet end comprises at least one contoured edge.

13. A fuel nozzle in accordance with claim 7 wherein said at least one suction side fuel injection orifice is fluidly coupled to said first fuel supply passage and said at least one pressure side fuel injection orifice is fluidly coupled to said second fuel supply passage.

14. A fuel nozzle in accordance with claim 7, wherein said at least one suction side fuel injection orifice facilitates reducing a fuel column penetration height and a flame holding velocity, said at least one pressure side fuel injection orifice facilitates eliminating jet cross flow.

15. A fuel nozzle in accordance with claim 7, wherein said at least one suction side fuel injection orifice with angled jet cross flow and said at least one pressure side fuel injection orifice with tangential jet coflow to facilitate eliminating fuel flow recirculation.

16. A fuel nozzle in accordance with claim 7, wherein there are at least two pressure side fuel injection orifices, and the at least two pressure side fuel injection orifices are separated by a distance that is more than twice a diameter of the at least one of the first fuel supply passage and a second fuel supply passage.

17. A gas turbine engine assembly comprising:

a compressor; and a combustor coupled in flow communication with said compressor, said combustor comprising at least one fuel nozzle assembly comprising:

a swirler assembly comprising:

a shroud;

a hub;

a plurality of vanes extending between said shroud and said hub, each of said vanes comprising:

a concave pressure sidewall and a convex suction sidewall coupled to said pressure sidewall at a leading edge and at an axially-spaced trailing edge;

at least one suction side fuel injection orifice defined adjacent to said leading edge in the suction sidewall, said at least one suction side fuel injection orifice extending from a first fuel supply passage to said suction sidewall and oriented at a fuel injection angle with respect to said suction sidewall, said at least one suction side fuel injection orifice is configured to discharge fuel from said suction sidewall at the fuel injection angle; and at least one pressure side fuel injection orifice formed in the pressure sidewall extending from at least one of the first fuel supply passage and a second fuel supply passage to said pressure sidewall, said at least one pressure side fuel injection orifice configured to discharge fuel tangentially downstream from said trailing edge.

18. A gas turbine engine assembly in accordance with claim 17, wherein said at least one suction side fuel injection orifice comprises an elongated slot formed in said suction sidewall and defined by at least one contoured edge.

19. A gas turbine engine assembly in accordance with claim 17, wherein said fuel injection angle is between about 30 and about 90 degrees.

20. A gas turbine engine assembly in accordance with claim 17, wherein said at least one pressure side fuel injection orifice comprises a fuel inlet end defined by at least one contoured edge, and an opposite fuel discharge end, said fuel inlet end is substantially circular, said fuel discharge end is elliptical.

21. A gas turbine engine assembly in accordance with claim 17, wherein said at least one suction side fuel injection orifice facilitates reducing a fuel column penetration height and a flame holding velocity, said at least one pressure side fuel injection orifice facilitates eliminating jet cross flow.

22. A gas turbine engine assembly in accordance with claim 17, wherein there are at least two pressure side fuel injection orifices, and the at least two pressure side fuel injection orifices are separated by a distance that is more than twice a diameter of the at least one of the first fuel supply passage and a second fuel supply passage.

* * * * *